US006759367B2

(12) United States Patent
Loccufier et al.

(10) Patent No.: US 6,759,367 B2
(45) Date of Patent: Jul. 6, 2004

(54) THERMOGRAPHIC RECORDING MATERIAL WITH IMPROVED PRINT ARCHIVABILITY WITHOUT LOSS IN PRINTABILITY

(75) Inventors: Johan Loccufier, Zwijnaarde (BE); Geert Defieuw, Bonheiden (BE); Ivan Hoogmartens, Wilrijk (BE)

(73) Assignee: AGFA-Gevaert, Mortsel (BE)

( * ) Notice: Subject to any disclaimer, the term of this patent is extended or adjusted under 35 U.S.C. 154(b) by 294 days.

(21) Appl. No.: 10/107,378

(22) Filed: Mar. 27, 2002

(65) Prior Publication Data

US 2003/0054958 A1 Mar. 20, 2003

Related U.S. Application Data

(60) Provisional application No. 60/291,528, filed on May 16, 2001.

(30) Foreign Application Priority Data

Mar. 29, 2001 (EP) ..... 01000096

(51) Int. Cl.[7] ..... B41M 5/30

(52) U.S. Cl. ..... 503/201; 503/208; 503/209; 503/212

(58) Field of Search ..... 503/201, 208, 503/209, 212

(56) References Cited

U.S. PATENT DOCUMENTS 3,751,249 A 8/1973 Hiller

FOREIGN PATENT DOCUMENTS

EP 0 692 733 A2 1/1996
EP 0 978 760 A1 2/2000

OTHER PUBLICATIONS

Bird, Clive W.; "Heteroaromaticity, 5, A Unified Aromaticity Index" *Tetrahedron*, vol. 48(2), 335–340, (1992).

*Primary Examiner*—B. Hamilton Hess
(74) *Attorney, Agent, or Firm*—Leydig, Voit & Mayer, Ltd.

(57) ABSTRACT

A monosheet black and white substantially light-insensitive thermographic recording material comprising a thermosensitive element and a support, the thermosensitive element containing a substantially light-insensitive organic silver salt, a 3,4-dihydroxybenzene compound in thermal working relationship therewith and a binder, wherein the 3,4-dihydroxybenzene compound is an aryloxo-3,4-dihydroxybenzene compound in which the aryl-group is substituted with at least one substituent having a $\sigma_m$-value greater than 0; or a heteroaryloxo-3,4-dihydroxybenzene compound in which the heteroaryl group has a unified aromaticity index $I_A$ greater than 53 and is optionally substituted with at least one group selected from the group consisting of aryl, hydroxy, carboxy, sulfo, sulfoalkyl, sulfoaryl, sulfonylalkyl, sulfonylaryl, annulated aryl, annulated heteroaryl, carboxyalkyl, carboxyaryl, oxoalkyl, oxoaryl, halogen, nitro, cyano and mercapto-alkyl groups; and a thermographic recording process therefor.

12 Claims, No Drawings

THERMOGRAPHIC RECORDING MATERIAL WITH IMPROVED PRINT ARCHIVABILITY WITHOUT LOSS IN PRINTABILITY

This application claims the benefit of U.S. Provisional Application No. 60/291,528 filed May 16, 2001, which is incorporated by reference.

FIELD OF THE INVENTION

The present invention relates to thermographic recording materials whose prints have improved archival properties without loss in printability.

BACKGROUND OF THE INVENTION.

Thermal imaging or thermography is a recording process wherein images are generated by the use of thermal energy. In direct thermal thermography a visible image pattern is formed by image-wise heating of a recording material.

EP 692 733 discloses a direct thermal recording process wherein a direct thermal recording material is heated dot-wise and the direct thermal recording material comprises on a substrate an imaging layer containing uniformly distributed in a film-forming polymeric binder (i) one or more substantially light-insensitive organic silver salts being no double salts, the silver salt(s) being in thermal working relationship with (ii) an organic reducing agent therefor, characterized in that wherein the reducing agent is a benzene compound the benzene nucleus of which is substituted by no more than two hydroxy groups which are present in 3,4-position on the nucleus and have in the 1-position of the nucleus a substituent linked to the nucleus by means of a carbonyl group. In a preferred embodiment of EP-A 692 733 the preferred carbonyl substituted 3,4-dihydroxy-benzene reducing agents are selected from the group consisting of 3,4-dihydroxy-benzoic acid, an alkyl or aryl ester thereof, 3,4-dihydroxy-benzaldehyde, 3,4-dihydroxy-benzamide and aryl or alkyl (3,4-dihydroxyphenyl) ketones. EP-A 692 733 exemplifies 3,4-dihydroxy-benzophenone.

In printing with thermographic materials for medical applications for viewing with a light box, optimum diagnosis requires a blue-black image tone so that the higher ability of the human eye to distinguish detail with such image tone can be exploited, thereby improving the diagnostic value of such prints. Such image tone should be independent of the shelf-life of the thermographic recording material prior to printing and also of archival time after printing. Image tone can be assessed on the basis of the L*, a* and b* CIELAB-values as determined by spectrophotometric measurements according to ASTM Norm E179-90 in a R(45/0) geometry with evaluation according to ASTM Norm E308-90. It is not only important that fresh prints produced with substantially light-insensitive thermographic recording materials exhibit the bluish tone necessary for reliable diagnosis with X-ray images, but also that the image tone is substantially maintained during storage in the dark in archives and also while being view in transmission using light-boxes i.e. exposed to visible light. Substantially light-insensitive thermographic recording materials should therefore be capable of producing bluish prints upon printing and this image tone should be substantially maintained during storage in the dark and during viewing on a light box while maintaining their sensitometry. Prior art materials do not provide this balance of properties.

ASPECTS OF THE INVENTION

It is therefore an aspect of the present invention to provide a substantially light-insensitive thermographic recording materials capable of exhibiting a high printability as expressed by the ratio of Dmax to organic silver salt coverage together with thermographic prints with improved maintenance of image density levels e.g. for D=1.0 and sensitometry during storage in the dark.

Further aspects and advantages of the invention will become apparent from the description hereinafter.

SUMMARY OF THE INVENTION

It has been surprisingly found that substantially light-insensitive thermographic recording materials whose thermosensitive elements contain a substantially light-insensitive organic silver salt in thermal working relationship with 3,4-dihydroxyphenyloxo-aryl compounds in which the aryl group is substituted with particular substituents or 3,4-dihydroxyphenyloxo-heteroaryl compounds as a reducing agent, exhibit high printability as expressed by the ratio of Dmax to organic silver salt coverage together with thermographic prints with improved maintenance of image density levels e.g. for D=1.0 during storage in the dark The above mentioned aspects are realized by providing a monosheet black and white substantially light-insensitive thermographic recording material comprising a thermosensitive element and a support, the thermosensitive element containing a substantially light-insensitive organic silver salt, a 3,4-dihydroxybenzene compound in thermal working relationship therewith and a binder, wherein the 3,4-dihydroxybenzene compound is an aryloxo-3,4-dihydroxybenzene compound in which the aryl-group is substituted with at least one substituent having a $\sigma_m$-value greater than 0; or a heteroaryloxo-3,4-dihydroxybenzene compound in which the heteroaryl group has a unified aromaticity index $I_A$ greater than 53 and is optionally substituted with at least one group selected from the group consisting of aryl, hydroxy, carboxy, sulfo, sulfoalkyl, sulfoaryl, sulfonylalkyl, sulfonylaryl, annulated aryl, annulated heteroaryl, carboxyalkyl, carboxyaryl, oxoalkyl, oxoaryl, halogen, nitro, cyano and mercapto-alkyl groups.

The above mentioned aspects are also realized by providing a thermographic recording process for the above-mentioned monosheet black and white substantially light-insensitive thermographic recording material comprising the steps of: (i) providing the thermographic recording material; (ii) bringing the thermographic recording material into the proximity of a heat source; (iii) applying heat imagewise from the heat source to the thermographic recording material; and (iv) removing the thermographic recording material from the proximity of the heat source.

Different embodiments are disclosed in the dependent claims.

DETAILED DESCRIPTION OF THE INVENTION

According to a first embodiment of the thermographic recording process, according to the present invention, the heat source is a thermal head.

According to a second embodiment of the thermographic recording process according to the present invention, the heat source is a thin film thermal head.

DEFINITIONS

By substantially light-insensitive is meant not intentionally light sensitive.

The term double salt with respect to organic silver salts means that silver is associated with another cation e.g. a magnesium ion or an iron ion.

The term 3,4-dihydroxybenzene compound means a benzene compound with a substituent in the 1-position and hydroxy groups in the 3 and 4 positions.

The term annulated refers to a ring system in which two rings share two adjacent ring atoms.

Heating in association with the expression a substantially water-free condition as used herein, means heating at a temperature of 80 to 250° C. The term "substantially water-free condition" as used herein means that the reaction system is approximately in equilibrium with water in the air, and water for inducing or promoting the reaction is not particularly or positively supplied from the exterior to the element. Such a condition is described in T. H. James, "The Theory of the Photographic Process", Fourth Edition, Macmillan 1977, page 374.

An acyl group is a radical formed from an organic carboxylic acid by removal of a hydroxyl group and has the general formula RC═O, where R may be an aliphatic, alicyclic or aromatic group.

A heteroacyl group is a radical formed from a heterocyclic carboxylic acid by removal of a hydroxyl group and has the general formula R'C═O, where R' may be heteroaliphatic, heterocyclic or heteroaromatic group.

Hammett $\sigma_m$ substituent values are to be found in Advances in Linear Free Energy Relationships, Edited by N. B. Chapman and J. Shorter, published by Plenum Press, London in 1972 on pages 28–29, herein incorporated by reference.

The unified aromaticity index $I_A$ is described in C. W. Bird, Tetrahedron, 48(32), 335–340 (1992) and this publication also discloses aromaticity index values for a large range of aromatic groups, herein incorporated by reference.

Aryloxo- or Heteroaryloxo-3,4-dihydroxybenzene

According to a first embodiment of the substantially light-insensitive thermographic recording material of the present invention, the substituent of the aryl group of the aryloxo-3,4-dihydroxybenzene in the thermosensitive element thereof is selected from the group consisting of aryl, hydroxy, carboxy, sulfo, sulfoalkyl, sulfoaryl, sulfonylalkyl, sulfonylaryl, annulated aryl, annulated heteroaryl, carboxyalkyl, carboxyaryl, oxoalkyl, oxoaryl, halogen, nitro, cyano and mercapto-alkyl groups.

According to a second embodiment of the substantially light-insensitive thermographic recording material of the present invention, the heteroaryl group of the heteroaryloxo-3,4-dihydroxybenzene in the thermosensitive element thereof is selected from the group consisting of thiophenyl, pyrrolyl and pyridinyl groups.

According to a third embodiment of the substantially light-insensitive thermographic recording material of the present invention, the aryloxo group of the aryloxo-3,4-dihydroxybenzene in the thermosensitive element thereof, is selected from the group consisting of benzoyl, naphthoyl and anthracenoyl and phenanthrenoyl groups.

According to a fourth embodiment of the substantially light-insensitive thermographic recording material of the present invention, the aryloxo-3,4-dihydroxybenzene in the thermosensitive element thereof, is selected from the group consisting of 3,4-dihydroxy-4'-iodo-benzophenone, 3,4-dihydroxy-4'-bromo-benzophenone, 3,4-dihydroxy-4'-chloro-benzophenone, 3,4-dihydroxy-3'-chloro-benzophenone, 3,4-dihydroxy-3',4'-dichloro-benzophenone, 3,4-dihydroxy-4'-nitro-benzophenone and 3,4-dihydroxy-4'-cyano-benzophenone.

Suitable aryloxo- or heteroaryloxo-3,4-dihydroxybenzenes for use in the thermographic recording material of the present invention are:

R01

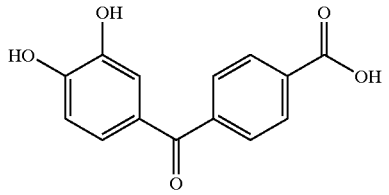

3,4-dihydroxy-4'-carboxybenzophenone
Melting point = 254° C.

R02

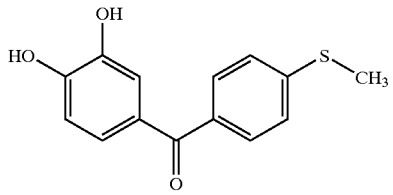

3,4-dihydroxy-4'-(methylmercapto)benzophenone
Melting point = 120° C.

R03

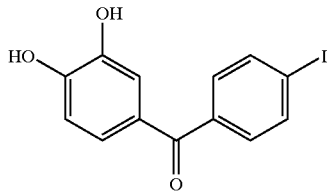

3,4-dihydroxy-4'-iodo-benzophenone
Melting point = 212° C.

-continued

| | | |
|---|---|---|
| R04 | 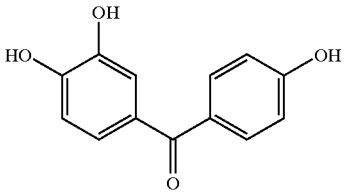 | 3,4-dihydroxy-4'-hydroxybenzo-phenone<br>Melting point = 208° C. |
| R05 | 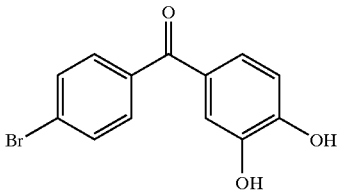 | 3,4-dihydroxy-4'-bromo-benzo-phenone<br>Melting point = 210° C. |
| R06 | 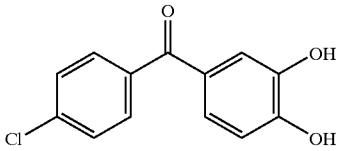 | 3,4-dihydroxy-4'-chloro-benzo-phenone<br>Melting point = 170–172° C. |
| R07 | 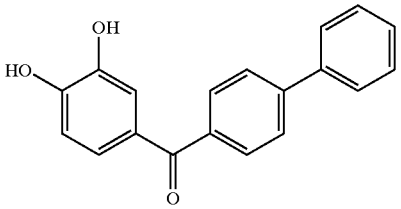 | 3,4-dihydroxy-4'-phenyl-benzo-phenone<br>Melting point = 209° C. |
| R08 | 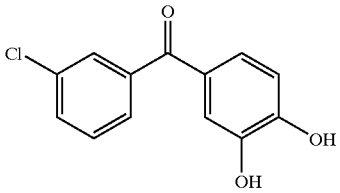 | 3,4-dihydroxy-3'-chloro-benzo-phenone<br>Melting point = 162° C. |
| R09 | 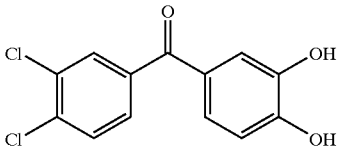 | 3,4-dihydroxy-3',4'-dichloro-benzophenone |
| R10 | 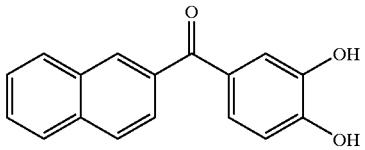 | 3,4-dihydroxy-(2-naphthyl)oxo-benzene, also known as (3,4-diphydroxy-phenyl)-naphthalen-2-yl-methanone |
| R11 | 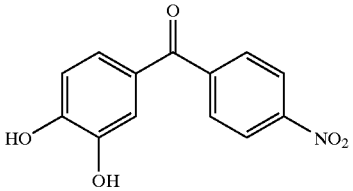 | 3,4-dihydroxy-4'-nitro-benzo-phenone<br>Melting point = 244° C. |

-continued

| | | |
|---|---|---|
| R12 | 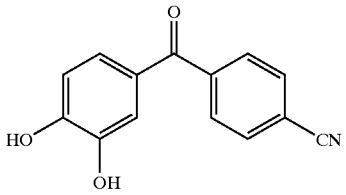 | 3,4-dihydroxy-4'-cyano-benzophenone |
| R13 | 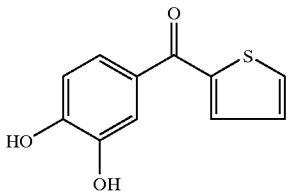 | 3,4-dihydroxy-(2-thiophenyl)oxobenzene, also known as (3,4-diphydroxy-phenyl)-thiophen-2-yl-methanone |
| R14 | 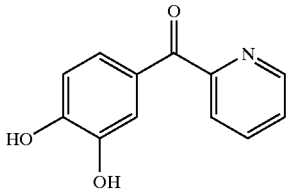 | 3,4-dihydroxy-(2-pyridyl)oxobenzene, also known as (3,4-diphydroxy-phenyl)-pyrid-2-yl-methanone |
| R15 | 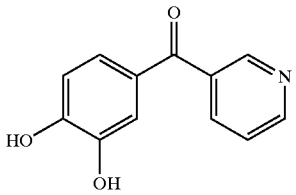 | 3,4-dihydroxy-(3-pyridyl)oxobenzene, also known as (3,4-diphydroxy-phenyl)-pyrid-3-yl-methanone |
| R16 | 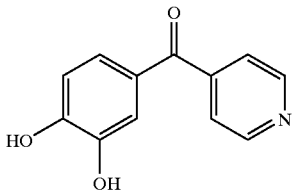 | 3,4-dihydroxy-(4-pyridyl)oxobenzene, also known as (3,4-diphydroxy-phenyl)-pyrid-4-yl-methanone |
| R17 | 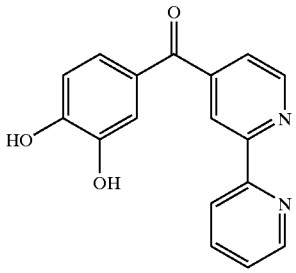 | 3,4-dihydroxy-{4-[2-(pyrid-2-yl)]-pyridyl)}-oxobenzene, also known as (3,4-diphydroxy-phenyl)-[2-(pyrid-2-yl)-pyrid-4-yl-methanone |

Combinations of aryloxo- or heteroaryloxo-3,4-dihydroxybenzene compounds may also be used that on heating become reactive partners in the reduction of the substantially light-insensitive organic silver salt.

Synthesis of Aryloxo- or Heteroaryloxo-3,4-dihydroxybenzenes 3,4-dihydroxyphenyloxobenzenes can be prepared according to well documented procedures. Direct Friedel Craft-acylation on catechol, using acylchlorides or anhydrides and Lewis acid activation has been reported in the following literature: anhydrides and $ZnCl_2$ in Indian J. Chem. Sect. B, 26B(9), 823–6 (1987); acylbromides and $AlBr_3$ in $CS_2$ as a solvent in Chem. Ber., 119(1), 50–64 (1986); acylchlorides and $AlCl_3$ in chlorobenzene as solvent in Org. Prep. Proced. Int. 17(6), 401–7 (1985); acylchlorides and $AlCl_3$ in nitrobenzene as solvent in J. Chem. Soc., Dalton Trans., (2), 641–5 (1990); and anhydrides and $AlCl_3$ in dichloroethane as solvent in Eur. J. Med. Chem., 23(1), 45–52 (1988).

The literature includes several reports of Fries rearrangements e.g. in J. Prakt. Chem. 329(5), 923–6 (1987) and Nippon Kagaku Kaishi, (4), 742–6 (1985). The yields reported for the Fries rearrangement are fairly low and it was found that direct Friedel Crafts acylation yielded fairly complex reaction mixtures, which hampered an easy purification.

Instead of optimizing the reaction conditions, the Friedel Crafts acylation has been effected on a protected catechol and the hydroxyl group deprotected after purification of the intermediates. The following general synthetic strategy was used:

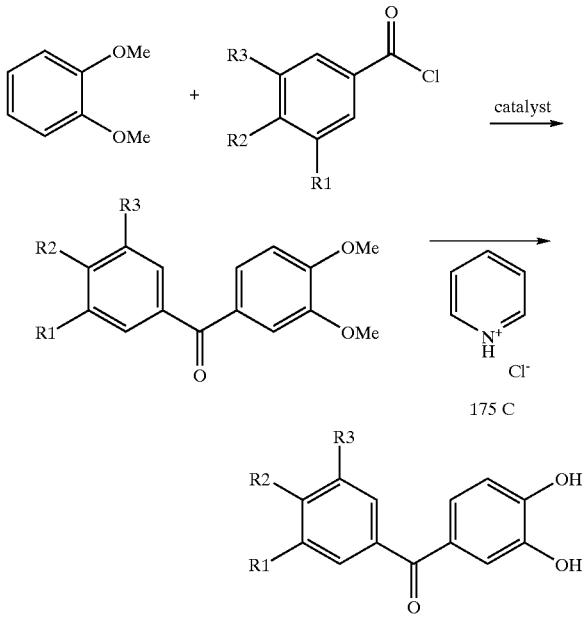

Veratrol was chosen as the protected catechol, due to its availability in bulk. Friedel Crafts acylations on 1,2-dialkoxy benzenes are well documented in the literature, using e.g. $FeCl_3$ as a catalyst [C.R. Acad. Sci., Ser. Iic: Chim., 2(7–8), 455–465 (1999) or $SnCl_4$ as catalyst (Eur. Pat. Appl., 839801 (1998); J. Org. Chem., 55(17), 5078–88 (1990), J. Med. Chem., 30(10) , 1914–18 (1987)]. Several other catalysts and acylating reagents have been reported in the literature (Chem. Commun. 16, 1567–1568 (1997); Tetrahedron, 52(43), 13623–13640 (1996); Fr. Demande, 2722781 (1996); J. Org. Chem. 60(22), 7086–7 (1995)). Though not preferred, some alternative synthetic strategies have been reported for the preparation of the intermediate dimethoxybenzophenones. In the first alternative an intermediate benzhydrol is oxidized to the corresponding benzophenone.

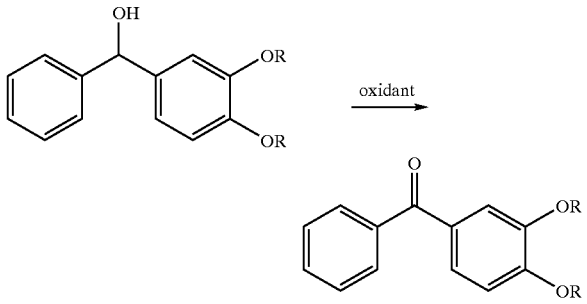

Typical examples are given in Helv. Chim. Acta, 72(5), 952–968 (1989), Indian J. Chem., Sect. B, 26B(11), 1025–9 (1987) and J. Org. Chem., 50(13), 2220–4 (1985). The required benzhydrols are accessible using organometallic chemistry as reported in Tetrahedron Lett., 38(5), 893–896 (1997), J. Labelled Compd. Radiopharm., 39(4), 303–318 (1997) and PCT Int. Appl., 9517399 (1995). Direct reaction of organometallic compounds with acyl chlorides or nitrites are a third possibility as documented in J. Med. Chem., 32(1), 192–7 (1989)and Tetrahedron Lett. 27(34), 3963–6 (1986).

Using one of the above mentioned strategies, 3,4-dihydroxy-heteroaryloxobenzenes are accessible. A typical example, where pyridyl derivatives are described, can be found in PCT Int. Appl. 9806700 (1998) , using the combination of organometallic chemistry to prepare the intermediate benzhydrol following oxidation of the benzhydrol to the corresponding ketone. A Friedel Crafts-acylation to prepare pyridyl derivatives has been reported in Ger. Offen., 4231632 (1994). Further oxidative strategies have been reported in Heterocycles 29(9), 1815–24 (1989), J. Heterocyclic Chem. 26(3), 811–815 (1989), Tetrahedron Lett, 36(7), 1001–2 (1995) and J. Org. Chem., 53(6) , 1176–83 (1988). From this literature it is clear that a wide range of heteroaryloxobenzenes can be prepared.

Independent of the strategy used to prepare the 3,4-dialkoxy aryloxobenzene intermediates, a dealkylation is required to obtained the claimed developers. Although different methods for cleavage aryl ethers have been reported in the literature, a reaction in a melt of pyridine chlorohydrate was chosen, as illustrated in the scheme above.

The structures of the aryloxo- or heteroaryloxo-3,4-dihydroxybenzene compounds synthesized were confirmed by $^1$H-NMR-spectroscopy.

Thermosensitive Element

The thermosensitive element as used herein is that element which contains all the ingredients which contribute to image formation. According to the present invention the thermosensitive element, contains a substantially light-insensitive organic silver salt, a 3,4-dihydroxybenzene compound as a reducing agent therefor in thermal working relationship therewith and a binder. The element may comprise a layer system in which the above-mentioned ingredients may be dispersed in different layers, with the proviso that the substantially light-insensitive organic silver salt is in reactive association with the reducing agent i.e. during the thermal development process the reducing agent must be present in such a way that it is able to diffuse to the particles of substantially light-insensitive organic silver salt, so that reduction to silver can occur.

Organic Silver Salt

According to a fifth embodiment of the substantially light-insensitive thermographic recording material of the present invention, the organic silver salt is not a double organic salt containing a silver cation associated with a second cation e.g. magnesium or iron ions.

According to a sixth embodiment of the substantially light-insensitive thermographic recording material of the present invention, the organic silver salt is a substantially light-insensitive silver salt of an organic carboxylic acid.

According to a seventh embodiment of the substantially light-insensitive thermographic recording material of the present invention, the organic silver salt is a substantially light-insensitive silver salt of an aliphatic carboxylic acids known as a fatty acid, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Other silver salts of an organic carboxylic acid as described in GB-P 1,439,478, e.g. silver benzoate, may likewise be used to produce a thermally developable silver image. Combinations of different silver salt of an organic carboxylic acids may also be used in the present invention, as disclosed in EP-A 964 300.

Organic silver salts may be dispersed by standard dispersion techniques e.g. using ball mills, bead mills, microfluidizers, ultrasonic apparatuses, rotor stator mixers etc. have been found to be useful in this regard. Mixtures of organic silver salt dispersions produced by different techniques may also be used to obtain the desired thermographic properties e.g. of coarser and a more finely ground dispersions of organic silver salts.

Auxiliary Reducing Agent

Combinations of aryloxo- or heteroaryloxo-3,4-dihydroxy-benzene compounds with at least one further reducing agent may also be used that on heating become reactive partners in the reduction of the substantially light-insensitive organic silver salt.

According to an eighth embodiment of the substantially light-insensitive thermographic recording material of the present invention, the thermosensitive element contains a reducing agent in addition to an aryloxo- or heteroaryloxo-3,4-dihydroxy-benzene compound.

According to a ninth embodiment of the substantially light-insensitive thermographic recording material of the present invention, the thermosensitive element further contains at least one reducing agent disclosed in EP-B 692 733 or a reducing agent disclosed in EP-A 903 625.

According to a tenth embodiment of the substantially light-insensitive thermographic recording material of the present invention, the thermosensitive element further contains at least one reducing agent selected from the group consisting of 3,4-dihydroxybenzoate alkyl and aryl esters (such as ethyl 3,4-dihydroxybenzoate or n-butyl 3,4-dihydroxybenzoate), 3,4-dihydroxybenzophenone, 3,4-dihydroxy-acetophenone and 3,4-dihydroxybenzonitrile.

Binder of the Thermosensitive Element

The film-forming binder of the thermosensitive element may be all kinds of natural, modified natural or synthetic resins or mixtures of such resins, in which the substantially light-insensitive organic silver salt can be dispersed homogeneously either in aqueous or solvent media: e.g. cellulose derivatives such as ethylcellulose, cellulose esters, e.g. cellulose nitrate, carboxymethylcellulose, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof.

According to a tenth embodiment of the substantially light-insensitive thermographic recording material of the present invention, the thermosensitive element contains a binder which does not contain additives or impurities which adversely affect the thermographic properties of the thermographic recording materials in which they are used.

Toning Agent

According to an eleventh embodiment of the substantially light-insensitive thermographic recording material of the present invention, the thermosensitive element further contains a so-called toning agent organic silver salt in order to obtain a neutral black image tone in the higher densities and neutral grey in the lower densities.

Suitable toning agents are described in U.S. Pat. Nos. 3,074,809, 3,446,648 and 3,844,797 and 4,082,901. Other particularly useful toning agents are the heterocyclic toning compounds of the benzoxazine dione or naphthoxazine dione type as disclosed in GB 1,439,478, U.S. Pat. Nos. 3,951,660 and 5,599,647.

According to a twelfth embodiment of the substantially light-insensitive thermographic recording material of the present invention, the thermosensitive element further contains one or more toning agents selected from the group consisting of phthalazinone, benzo[e] [1,3]oxazine-2,4-dione, 7-methyl-benzo[e] [1,3]oxazine-2,4-dione, 7-methoxy-benzo[e] [1,3]oxazine-2,4-dione and 7-(ethylcarbonato)-benzo[e] [1,3]oxazine-2,4-dione.

Stabilizers

Stabilizers may be incorporated into the substantially light-insensitive thermographic recording materials of the present invention in order to obtain improved shelf-life and reduced fogging.

According to a thirteenth embodiment of the substantially light-insensitive thermographic recording material of the present invention, the thermosensitive element further contains at least one stabilizer selected from the group consisting of benzotriazole; substituted benzotriazoles; tetrazoles; mercaptotetrazoles, such as 1-phenyl-5-mercapto-tetrazole; and aromatic polycarboxylic acids, such as ortho-phthalic acid, 3-nitro-phthalic acid, tetrachlorophthalic acid, mellitic acid, pyromellitic acid and trimellitic acid, and anhydrides thereof.

Polycarboxylic Acids and Anhydrides Thereof

According to the substantially light-insensitive thermographic recording material of the present invention the thermosensitive element may comprise in addition at least one optionally substituted aliphatic (saturated as well as unsaturated aliphatic and also cycloaliphatic) polycarboxylic acid and/or anhydride thereof in a molar percentage of at least 15 with respect to all the organic silver salt(s) present and in thermal working relationship therewith. The polycarboxylic acid may be used in anhydride form or partially esterified form on the condition that at least two free carboxylic acids remain or are available in the heat recording step.

According to a fourteenth embodiment of the substantially light-insensitive thermographic recording material of the present invention, the thermosensitive element further contains glutaric acid.

Surfactants and Dispersion Agents

Surfactants and dispersants aid the dispersion of ingredients or reactants which are insoluble in the particular dispersion medium. The thermographic recording materials of the present invention may contain one or more surfactants, which may be anionic, non-ionic or cationic surfactants and/or one or more dispersants.

Other Additives

The recording material may contain in addition to the ingredients mentioned above other additives such as levelling agents e.g. BAYSILON™ MA (from BAYER AG, GERMANY).

Support

The support for the thermosensitive element according to the present invention may be transparent, translucent or opaque and is a thin flexible carrier made of transparent resin film, e.g. made of a cellulose ester, cellulose triacetate, polypropylene, polycarbonate or polyester, e.g. polyethylene terephthalate.

The support may be in sheet, ribbon or web form and subbed if need be to improve the adherence to the thereon coated thermosensitive element. It may be pigmented with a blue pigment as so-called blue-base. One or more backing layers may be provided to control physical properties such as curl and static.

Protective Layer

According to a fifteenth embodiment of the substantially light-insensitive thermographic recording material of the present invention, the thermosensitive element is provided with a protective layer to avoid local deformation of the thermosensitive element and to improve resistance against abrasion.

According to a sixteenth embodiment of the substantially light-insensitive thermographic recording material of the present invention, the thermosensitive element is provided with a protective layer comprising a binder, which may be solvent-soluble, solvent-dispersible, water-soluble or water-dispersible.

According to a seventeenth embodiment of the substantially light-insensitive thermographic recording material of the present invention, the thermosensitive element is provided with a protective layer comprising solvent-soluble polycarbonates as binders as described in EP-A 614 769.

According to an eighteenth embodiment of the substantially light-insensitive thermographic recording material of the present invention, the thermosensitive element is provided with a protective layer comprising a water-soluble or water-dispersible binder, as coating can be performed from an aqueous composition and mixing of the protective layer with the immediate underlayer can be avoided by using a solvent-soluble or solvent-dispersible binder in the immediate underlayer. The protective layer according to the present invention may be crosslinked. Crosslinking can be achieved by using crosslinking agents such as described in WO 95/12495. Solid or liquid lubricants or combinations thereof are suitable for improving the slip characteristics of the thermographic recording materials according to the present invention.

According to an nineteenth embodiment of the substantially light-insensitive thermographic recording material of the present invention, the thermosensitive element is provided with a protective layer comprising a solid thermomeltable lubricant such as those described in WO 94/11199.

The protective layer of the thermographic recording material according to the present invention may comprise a matting agent. According to a twentieth embodiment of the substantially light-insensitive thermographic recording material of the present invention, the thermosensitive element is provided with a protective layer comprising a matting agent such as described in WO 94/11198, e.g. talc particles, and optionally protrude from the protective layer.

Coating

The coating of any layer of the recording material of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Thermographic Processing

Thermographic imaging is carried out by the image-wise application of heat either in analogue fashion by direct exposure through an image or by reflection from an image, or in digital fashion pixel by pixel either by using an infra-red heat source, for example with a Nd-YAG laser or other infra-red laser, with a substantially light-insensitive thermographic material preferably containing an infra-red absorbing compound, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. The operating temperature of common thermal printheads is in the range of 300 to 400° C. and the heating time per picture element (pixel) may be less than 1.0 ms, the pressure contact of the thermal printhead with the recording material being e.g. 200–500 g/cm$^2$ to ensure a good transfer of heat.

In order to avoid direct contact of the thermal printing heads with the outermost layer on the same side of the support as the thermosensitive element when this outermost layer is not a protective layer, the image-wise heating of the recording material with the thermal printing heads may proceed through a contacting but removable resin sheet or web wherefrom during the heating no transfer of recording material can take place.

Activation of the heating elements can be power-modulated or pulse-length modulated at constant power. EP-A 654 355 discloses a method for making an image by image-wise heating by means of a thermal head having energizable heating elements, wherein the activation of the heating elements is executed duty cycled pulsewise. EP-A 622 217 discloses a method for making an image using a direct thermal imaging element producing improvements in continuous tone reproduction.

Image-wise heating of the recording material can also be carried out using an electrically resistive ribbon incorporated into the material. Image- or pattern-wise heating of the recording material may also proceed by means of pixel-wise modulated ultra-sound.

Industrial Application

Thermographic imaging can be used for the production of reflection type prints and transparencies, in particular for use in the medical diagnostic field in which black-imaged transparencies are widely used in inspection techniques operating with a light box.

Synthesis of Aryloxo- and Heteroaryloxo-3,4-dihydroxybenzenes

The synthesis of (4-choro-phenyl)-(3,4-dihydroxy-phenyl)-methanone is given below to illustrate the synthesis of the reducing agents used in the substantially light-insensitive thermographic recording material of the present invention. In the first step veratrol was Friedel Crafts acylated with 4-chloro-benzoylchloride:

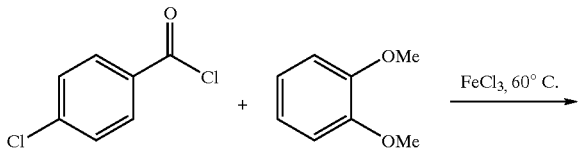

(excess and solvent)

-continued

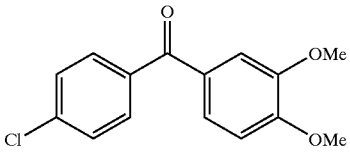

by adding 260 g (1.6 mol) of $FeCl_3$ portionwise to 775 mL of veratrol. During the addition the temperature rose to 50° C. While maintaining the temperature at 55° C., 262.5 g (192 mL, 1.5 mol) 4-chloro-bezoylchloride was added. The reaction temperature was maintained at 60° C. for 10 hours. 1.5 L of deionized water was then added and the black suspension extracted with 2.5 L of methylene chloride. Addition of 500 mL of methanol was required to dissolve the precipitate. The aqueous layer was again extracted with 1 L of methylene chloride. The combined methylene chloride-extracts were washed with 500 ml water and dried over $MgSO_4$. The methylene chloride-extract was evaporated under reduced pressure and the dark residue was redissolved in methylene chloride. The polar byproducts were removed by filtration over a silica layer (eluant methylene chloride). After evaporation under reduced pressure, the oily residue was crystallized from 500 mL ethanol (yield: 40%).

Demethylation of the intermediate dimethoxybenzophenone was carried out heating 115 g of the intermediate 4-chloro-3'4'-dimethoxybenzophenone and 185 g pyridine chlorohydrate at 170° C. for 12 hours. After cooling to room temperature, 500 mL was added and

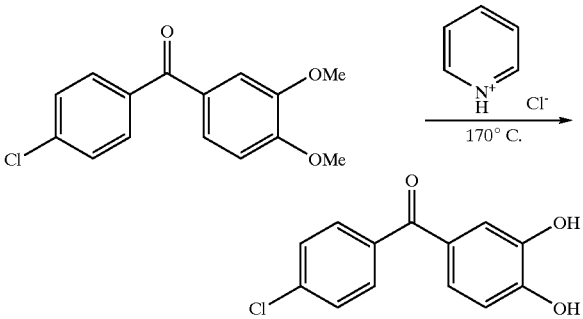

(4-choro-phenyl)-(3,4-dihydroxy-phenyl)-methanone precipitated out as a grey powder. The compound was finally purified by preparative chromatography (NP-silica, eluant: hexane/ethyl acetate 70/30, $R_f$:0.3), yielding 41% of a highly pure compound whose structure was confirmed by $^1$H-NMR-spectroscopy.

The invention is illustrated hereinafter by way of comparative examples and invention examples. The percentages and ratios given in these examples are by weight unless otherwise indicated. The ingredients used in the thermosensitive element of the substantially light-insensitive recording materials of the INVENTION and COMPARATIVE EXAMPLES, are:

organic silver salts:
- AgB=silver behenate;

reducing agent according to EP-A 692733):
- CR01=ethyl 3,4-dihydroxybenzoate;
- CR02=3,4-dihydroxybenzophenone;
- CR03=3,4-dihydroxyacetophenone;
- CR04=3,4-dihydroxy-4'-methyl-benzophenone;
- CR05=3,4-dihydroxy-(2-furanyl)oxobenzene, also known as (3,4-dihydroxy-phenyl)-furan-2-yl -methanone binder:
- BLSHP=S-LEC BLSHP, a polyvinylbutyral from Sekusui;

the toning agents:
- T01=benzo[e] [1,3]oxazine-2,4-dione;
- T02=7-(ethylcarbonato) -benzo[e] [1,3]oxazine-2,4-dione;

the stabilizers:
- S01=glutaric acid;
- S02=tetrachlorophthalic acid anhydride;
- S03=benzotriazole.

INVENTION EXAMPLES 1 to 12 and COMPARATIVE EXAMPLES 1 to 5

Preparation of the Thermosensitive Element

The thermosensitive elements of COMPARATIVE EXAMPLES 1 to 12 and COMPARATIVE EXAMPLES 1 to 5 were produced by coating a 2-butanone dispersion with the following ingredients onto a subbed 168 μm thick blue-pigmented polyethylene terephthalate support, with CIELAB a* and b* values of −7.9 and −16.6 respectively, to produce layers with the compositions given in Table 1.

TABLE 1

| | protective layer | | | | | | | | | |
|---|---|---|---|---|---|---|---|---|---|---|
| | | Reducing agent | | | T01 | T02 | S01 | S02 | S03 | |
| | AgB [g/m²] | type | mol % vs AgB | BL5HP [g/m²] | mol % vs AgB | mol % vs AgB | mol % vs AgB | mol % vs AgB | mol % vs AgB | Oil [g/m²] |
| Invention Example nr. | | | | | | | | | | |
| 1 | 3.82 | R01 | 50 | 15.28 | 15 | 5 | 24 | 4.91 | 9.84 | 0.0339 |
| 2 | 3.92 | R02 | 50 | 15.68 | 15 | 5 | 24 | 4.91 | 9.84 | 0.0347 |
| 3 | 4.11 | R03 | 50 | 16.44 | 15 | 5 | 24 | 4.91 | 9.84 | 0.0365 |
| 4 | 4.00 | R04 | 50 | 16.00 | 15 | 5 | 24 | 4.91 | 9.84 | 0.0356 |
| 5 | 4.06 | R05 | 50 | 16.24 | 15 | 5 | 24 | 4.91 | 9.84 | 0.0360 |
| 6 | 3.87 | R06 | 50 | 15.48 | 15 | 5 | 24 | 4.91 | 9.84 | 0.0343 |
| 7 | 3.82 | R07 | 50 | 15.28 | 15 | 5 | 24 | 4.91 | 9.84 | 0.0339 |
| 8 | 4.03 | R08 | 50 | 16.12 | 15 | 5 | 24 | 4.91 | 9.84 | 0.0358 |
| 9 | 3.92 | R09 | 50 | 15.68 | 15 | 5 | 24 | 4.91 | 9.84 | 0.0347 |
| 10 | 3.92 | R10 | 50 | 15.68 | 15 | 5 | 24 | 4.91 | 9.84 | 0.0347 |

TABLE 1-continued

| | | Reducing agent | | | protective layer | | | | | |
|---|---|---|---|---|---|---|---|---|---|---|
| | | | | | T01 | T02 | S01 | S02 | S03 | |
| | AgB [g/m²] | type | mol % vs AgB | BL5HP [g/m²] | mol % vs AgB | mol % vs AgB | mol % vs AgB | mol % vs AgB | mol % vs AgB | Oil [g/m²] |
| 11 | 3.66 | R11 | 50 | 14.65 | 15 | 5 | 24 | 4.91 | 9.84 | 0.0325 |
| 12 | 3.58 | R12 | 50 | 14.33 | 15 | 5 | 24 | 4.91 | 9.84 | 0.0318 |
| Comparative Example nr. | | | | | | | | | | |
| 1 | 3.90 | CR01 | 50 | 15.60 | 15 | 5 | 24 | 4.91 | 9.84 | 0.0346 |
| 2 | 3.74 | CR02 | 50 | 14.96 | 15 | 5 | 24 | 4.91 | 9.84 | 0.0332 |
| 3 | 3.66 | CR03 | 50 | 14.64 | 15 | 5 | 24 | 4.91 | 9.84 | 0.0325 |
| 4 | 4.06 | CR04 | 50 | 16.24 | 15 | 5 | 24 | 4.91 | 9.84 | 0.0360 |
| 5 | 3.79 | CR05 | 50 | 15.17 | 15 | 5 | 24 | 4.91 | 9.84 | 0.0336 |

The thermosensitive elements of the thermographic recording materials of INVENTION EXAMPLES 1 to 12 and COMPARATIVE EXAMPLES 1 to 5 were then coated with an aqueous composition with the following composition:

| | |
|---|---|
| polyvinylalcohol (Polyviol ™ WX 48 20 from Wacker Chemie): | 2.1 g/m² |
| colloidal silica (Levasil ™ VP AC 4055 from Bayer AG, a 15% aqueous dispersion of colloidal silica): | 1.05 g/m² |
| Ultravon ™ W (dispersion agent from Ciba Geigy) converted into acid form by passing through ion exchange column: | 0.075 g/m² |
| silica (Syloid ™ 72 from Grace): | 0.09 g/m² |
| mono [isotridecyl polyglycolether (3 EO)] phosphate Servoxyl ™ VPDZ 3/100 from Servo Delden B.V.): | 0.075 g/m² |
| mixture of monolauryl and dilauryl phosphate (Servoxyl ™ VPAZ 100 from Servo Delden B.V): | 0.075 g/m² |
| talc (MICROACE type P3 from Nippon Talc): | 0.045 g/m² |
| glycerine monotallow acid ester (Rilanit ™ GMS from Henkel AG): | 0.15 g/m² |
| tetramethylorthosilicate hydrolyzed in the presence of methanesulfonic acid: | 0.87 g/m² |

The pH of the coating composition was adjusted to a pH of 4 by adding 1N nitric acid. Those lubricants which were insoluble in water, were dispersed in a ball mill with, if necessary, the aid of a dispersion agent. The composition was coated to a wet layer thickness of 85μm and then dried at 40° C. for 15 minutes and hardened for 7 days at 57° C. and a relative humidity of 34% thereby producing the thermographic recording materials of INVENTION EXAMPLES 1 to 12 and COMPARATIVE EXAMPLES 1 to 5.

Thermographic Printing

The thermographic recording materials of INVENTION EXAMPLES 1 to 12 and COMPARATIVE EXAMPLES 1 to 5 were printed using a DRYSTAR® 2000 printer from AGFA-GEVAERT equipped with a thin film thermal head with adapted to increase its resolution from 300 dpi (standard) to 508 dpi and operated with a line time of 12 ms and a maximum printing power of 34 mW/pixel (the line time being the time needed for printing one line). During this line time the print head received constant power. The thermal head resistors were time-modulated to produce different image densities.

The maximum densities of the images ($D_{max}$) measured through a visible filter with a MACBETH™ TR924 densitometer in the grey scale step corresponding to a data level of 64 are given in Table 2 for INVENTION EXAMPLES 1 to 12 and COMPARATIVE EXAMPLES 1 to 5.

Image Evaluation

The image tone of fresh prints made with the substantially light-insensitive thermographic recording materials of INVENTION EXAMPLES 1 to 12 and COMPARATIVE EXAMPLES 1 to 5 was assessed on the basis of the L*, a* and b* CIELAB-values. The L*, a* and b* CIELAB-values were determined by spectrophotometric measurements according to ASTM Norm E179-90 in a R(45/0) geometry with evaluation according to ASTM Norm E308-90. The a* and b* CIELAB-values of fresh prints of the substantially light-insensitive thermographic recording materials of INVENTION EXAMPLES 1 to 12 and COMPARATIVE EXAMPLES 1 to 5 at an optical density, D, of 1.0 are given in Table 2.

In the CIELAB-system a negative CIELAB a*-value indicates a greenish image-tone becoming greener as a* becomes more negative, a positive a*-value indicating a reddish image-tone becoming redder as a* becomes more positive. A negative CIELAB b*-value indicates a bluish tone which becomes increasingly bluer as b* becomes more negative and a positive b*-value indicates a yellowish image-tone becoming more yellow as b* becomes more positive. In terms of the visual perception of an image as a whole, the image tone of elements of the image with a density of 1.0 have a stronger effect than the image tone of elements with lower or higher optical density.

It is clear from Table 2, that the substantially light-insensitive thermographic recording material of COMPARATIVE EXAMPLE 3 with reducing agent CR03 (=3, 4-dihydroxybenzonitrile) exhibited a significantly lower printability, a Dmax/silver behenate ratio of 0.65 m²/g, that those of the other substantially light-insensitive thermographic recording materials in the table.

TABLE 2

| | Reducing agent | AgB coverage [g/m²] | $D_{max}$ (vis) | $D_{min}$ (vis) | $D_{max}$/AgB coverage [m²/g] | fresh print CIELAB values: D = 1.0 a* | b* |
|---|---|---|---|---|---|---|---|
| Invention Example nr. | | | | | | | |
| 1 | R01* | 3.82 | 2.77 | 0.23 | 0.73 | +11.14 | +12.12 |
| 2 | R02 | 3.92 | 3.55 | 0.22 | 0.91 | −0.93 | −8.38 |
| 3 | R03 | 4.11 | 3.22 | 0.22 | 0.78 | −3.83 | −8.14 |
| 4 | R04 | 4.00 | 3.43 | 0.22 | 0.86 | +16.85 | +9.24 |
| 5 | R05 | 4.06 | 3.21 | 0.22 | 0.79 | −4.01 | −7.64 |
| 6 | R06 | 3.87 | 3.22 | 0.22 | 0.83 | −3.89 | −7.92 |
| 7 | R07 | 3.82 | 3.35 | 0.22 | 0.88 | −1.73 | −8.78 |
| 8 | R08 | 4.03 | 3.08 | 0.22 | 0.76 | −3.85 | −7.92 |
| 9 | R09 | 3.92 | 3.01 | 0.22 | 0.77 | −4.24 | −5.99 |
| 10 | R10 | 3.92 | 3.52 | 0.22 | 0.90 | −1.76 | −8.89 |
| 11 | R11 | 3.66 | 3.00 | 0.22 | 0.82 | −2.90 | −3.73 |
| 12 | R12 | 3.58 | 3.15 | 0.22 | 0.88 | −1.97 | −7.46 |
| Comparative Example nr. | | | | | | | |
| 1 | CR01 | 3.90 | 3.22 | 0.23 | 0.83 | −2.31 | −9.27 |
| 2 | CR02 | 3.74 | 3.18 | 0.22 | 0.85 | −2.46 | −8.84 |
| 3 | CR03 | 3.66 | 2.37 | 0.23 | 0.65 | −3.24 | −6.34 |
| 4 | CR04 | 4.06 | 3.39 | 0.22 | 0.83 | −2.76 | −9.84 |
| 5 | CR05 | 3.79 | 3.20 | 0.22 | 0.84 | −2.54 | −8.89 |

*reducing agent incompletely dissolved.

If the image tone of fresh prints obtained with the substantially light-insensitive thermographic recording materials of INVENTION EXAMPLES 1 to 12 are compared, the substantially light-insensitive thermographic recording materials of INVENTION EXAMPLE 2, 3, 5 to 10 and 12 exhibit much bluer image tones at a density of shown by their simultaneously exhibiting highly positive a* and highly positive b* CIELAB-values.

Archivability Tests

Three series of simulated long-term archivability tests were performed by heating prints produced with thermographic recording materials of INVENTION EXAMPLES 1 to 12 and COMPARATIVE EXAMPLES 1 to 5, at 57° C. in 34% relative humidity for 3 days and at 45° C. in 70% relative humidity for 4 days. The changes in density, a* CIELAB-value and b* CIELAB-value with respect to the fresh prints were monitored for an initial density of 1.0. The results obtained are summarized in Table 3.

TABLE 3

| | Reducing agent | $D_{max}$/AgB coverage [m²/g] | ΔD for D = 1.0 on heating in dark for: 3 d/57° C./34% RH | 4 d/45° C./70% RH |
|---|---|---|---|---|
| Invention Example nr. | | | | |
| 1 | R01 | 0.73 | 0.00 | 0.00 |
| 2 | R02 | 0.91 | +0.14 | +0.05 |
| 3 | R03 | 0.78 | +0.10 | +0.03 |
| 4 | R04 | 0.86 | 0.00 | +0.02 |
| 5 | R05 | 0.79 | +0.14 | +0.03 |
| 6 | R06 | 0.83 | +0.14 | +0.05 |
| 7 | R07 | 0.88 | +0.10 | +0.05 |
| 8 | R08 | 0.76 | +0.17 | +0.05 |
| 9 | R09 | 0.77 | +0.10 | 0.00 |
| 10 | R10 | 0.90 | +0.10 | +0.05 |
| 11 | R11 | 0.82 | +0.06 | +0.02 |
| 12 | R12 | 0.88 | +0.08 | +0.03 |
| Comparative Example nr. | | | | |
| 1 | CR01 | 0.83 | +0.29 | +0.19 |
| 2 | CR02 | 0.85 | +0.19 | +0.10 |
| 3 | CR03 | 0.65 | +0.09 | +0.05 |
| 4 | CR04 | 0.83 | +0.19 | +0.10 |
| 5 | CR05 | 0.84 | +0.26 | +0.14 |

It is clear from the results in Table 3 that the change in density at 1.0 was significantly lower for the substantially light-insensitive thermographic recording materials of INVENTION EXAMPLES 1 to 12 i.e. the archivability was better than that observed for the substantially light-insensitive thermographic recording materials of COMPARATIVE EXAMPLES 1, 2, 4 and 5 for comparable printabilities as expressed by the ratio of Dmax/silver behenate coverage. The substantially light-insensitive recording material of COMPARATIVE EXAMPLE 3 exhibited comparable archivability to those of INVENTION EXAMPLES 1 to 12, but at the expense of a considerably reduced printability, as expressed by the Dmax/silver behenate coverage ratio.

The changes in CIELAB-values at D=1.0 upon heating in the dark for 3 days at 57° C. and 34% relative humidity for the substantially light-insensitive thermographic recording materials of INVENTION EXAMPLES 2, 3 and 5 to 12 are given in Table 4.

TABLE 4

| Invention Example nr. | Reducing agent | Change in CIELAB values at D = 1.0 on heating in dark for 3 d/57° C./34% RH Δa* | Δb* |
|---|---|---|---|
| 2 | R02 | +0.7 | +7.2 |
| 3 | R03 | −0.1 | +0.6 |
| 5 | R05 | −0.1 | +0.6 |
| 6 | R06 | +0.1 | +0.6 |
| 7 | R07 | +0.4 | +4.4 |
| 8 | R08 | −0.2 | +0.4 |
| 9 | R09 | −1.0 | −2.2 |
| 10 | R10 | +0.6 | +4.5 |
| 11 | R11 | −0.5 | −1.0 |
| 12 | R12 | −1.0 | +0.2 |

If the image tone of fresh prints obtained with the substantially light-insensitive thermographic recording materials of INVENTION EXAMPLES 2,3 and 5 to 12 are compared, prints of the substantially light-insensitive thermographic recording materials of INVENTION EXAMPLES 3, 5, 6, 8 and 9 with the reducing agents R03, R05, R06, R08, R09, R11 and R12 exhibited a much more stable image tone than substantially light-insensitive thermographic recording materials of INVENTION EXAMPLES 2, 7 and 10 with reducing agents R02, R07 and R10' as seen by the much lower shifts in a* - and b*-values.

Having described in detail preferred embodiments of the current invention, it will now be apparent to those skilled in the art that numerous modifications can be made therein without departing from the scope of the invention as defined in the following claims.

We claim:

1. A monosheet black and white substantially light-insensitive thermographic recording material comprising a thermosensitive element and a support, the thermosensitive element containing a substantially light-insensitive organic silver salt, a 3,4-dihydroxybenzene compound in thermal working relationship therewith and a binder, wherein said 3,4-dihydroxybenzene compound is an aryloxo-3,4-dihydroxybenzene compound in which the aryl-group is substituted with at least one substituent having a $\sigma_m$-value greater than 0; or a heteroaryloxo-3,4-dihydroxybenzene compound in which the heteroaryl group has a unified aromaticity index $I_A$ greater than 53 and is optionally substituted with at least one group selected from the group consisting of aryl, hydroxy, carboxy, sulfo, sulfoalkyl, sulfoaryl, sulfonylalkyl, sulfonylaryl, annulated aryl, annulated heteroaryl, carboxyalkyl, carboxyaryl, oxoalkyl, oxoaryl, halogen, nitro, cyano and mercapto-alkyl groups.

2. Thermographic recording material according to claim 1, wherein said substituent is selected from the group consisting of aryl, hydroxy, carboxy, sulfo, sulfoalkyl, sulfoaryl, sulfonylalkyl, sulfonylaryl, annulated aryl, annulated heteroaryl, carboxyalkyl, carboxyaryl, oxoalkyl, oxoaryl, halogen, nitro, cyano and mercapto-alkyl groups.

3. Thermographic recording material according to claim 1, wherein said heteroaryl group is selected from the group consisting of thiophenyl, pyrrolyl and pyridinyl groups.

4. Thermographic recording material according to claim 1, wherein said aryl group of said aryloxo-3,4-dihydroxybenzene compound or said heteroaryl group of said heteroaryloxo-3,4-dihydroxybenzene compound is not substituted with an acidic group.

5. Thermographic recording material according to claim 1, wherein said aryloxo- group is selected from the group consisting of benzoyl, naphthoyl and anthracenoyl and phenanthrenoyl groups.

6. Thermographic recording material according to claim 1, wherein said 3,4-dihydroxybenzene compound is selected from the group consisting of 3,4-dihydroxy-4'-iodo-benzophenone, 3,4-dihydroxy-4'-bromo-benzophenone, 3,4-dihydroxy-4'-chloro-benzophenone, 3,4-dihydroxy-3'-chloro-benzophenone, 3,4-dihydroxy-3',4'-dichloro-benzophenone, 3,4-dihydroxy-4'-nitro-benzophenone and 3,4-dihydroxy-4'-cyano-benzophenone.

7. Thermographic recording material according to claim 1, wherein said organic silver salt is not a double salt.

8. Thermographic recording material according to claim 1, wherein said thermosensitive element further comprises a reducing agent selected from the group consisting of 3,4-dihydroxybenzoate alkyl and aryl esters, 3,4-dihydroxybenzophenone, 3,4-dihydroxy-acetophenone and 3,4-dihydroxybenzonitrile.

9. Thermographic recording material according to claim 1, wherein said thermosensitive element further comprises one or more toning agents selected from the group consisting of phthalazinone, benzo[e] [1,3]oxazine-2,4-dione, 7-methyl-benzo[e] [1,3]oxazine-2,4-dione, 7-methoxy-benzo[e] [1,3]oxazine-2,4-dione and 7-(ethylcarbonato)-benzo[e] [1,3]oxazine-2,4-dione.

10. Thermographic recording material according to claim 1, wherein said thermosensitive element further comprises at least one optionally substituted aliphatic polycarboxylic acid and/or anhydride thereof in a molar percentage of at least 15 with respect to all the organic silver salt(s) present and in thermal working relationship therewith.

11. Thermographic recording material according to claim 10, wherein said optionally substituted aliphatic polycarboxylic acid and/or anhydride is glutaric acid.

12. A thermographic recording process for a monosheet black and white substantially light-insensitive thermographic recording material, said light-insensitive recording material comprising a thermosensitive element and a support, said thermosensitive element containing a substantially light-insensitive organic silver salt, a 3,4-dihydroxybenzene compound in thermal working relationship therewith and a binder, wherein said 3,4-dihydroxybenzene compound is an aryloxo-3,4-dihydroxybenzene compound in which the aryl-group is substituted with at least one substituent having a $\sigma_m$-value greater than 0; or a heteroaryloxo-3,4-dihydroxybenzene compound in which the heteroaryl group has a unified aromaticity index $I_A$ greater than 53 and is optionally substituted with at least one group selected from the group consisting of aryl, hydroxy, carboxy, sulfo, sulfoalkyl, sulfoaryl, sulfonylalkyl, sulfonylaryl, annulated aryl, annulated heteroaryl, carboxyalkyl, carboxyaryl, oxoalkyl, oxoaryl, halogen, nitro, cyano and mercapto-alkyl groups, comprising the steps of: (i) providing said thermographic recording material; (ii) bringing said thermographic recording material into the proximity of a heat source; (iii) applying heat imagewise from said heat source to said thermographic recording material; and (iv) removing said thermographic recording material from the proximity of said heat source.

* * * * *